US009053831B2

(12) United States Patent
Saito et al.

(10) Patent No.: US 9,053,831 B2
(45) Date of Patent: Jun. 9, 2015

(54) SHOCK-ABSORBING DEVICE FOR FUEL ASSEMBLY AND FUEL ASSEMBLY HOUSING CONTAINER

(75) Inventors: Yoshiyuki Saito, Hyogo (JP); Takeshi Yokoyama, Hyogo (JP); Junichi Kishimoto, Hyogo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 624 days.

(21) Appl. No.: 13/062,605

(22) PCT Filed: Aug. 25, 2009

(86) PCT No.: PCT/JP2009/064805

§ 371 (c)(1),
(2), (4) Date: Mar. 7, 2011

(87) PCT Pub. No.: WO2010/061669

PCT Pub. Date: Jun. 3, 2010

(65) Prior Publication Data

US 2011/0158372 A1 Jun. 30, 2011

(30) Foreign Application Priority Data

Nov. 28, 2008 (JP) ..... 2008-305588

(51) Int. Cl.
*G21C 3/30* (2006.01)
*G21F 5/012* (2006.01)
(Continued)

(52) U.S. Cl.
CPC *G21F 5/012* (2013.01); *G21F 5/08* (2013.01); *G21F 9/36* (2013.01)

(58) Field of Classification Search
CPC ..... G21F 5/012; G21F 5/08; G21F 9/36
USPC ..... 376/285
See application file for complete search history.

(56) References Cited

U.S. PATENT DOCUMENTS

| | | | | |
|---|---|---|---|---|
| 4,755,351 | A * | 7/1988 | Baloh et al. | 376/362 |
| 2005/0287053 | A1* | 12/2005 | Sakai et al. | 422/196 |
| 2007/0108086 | A1* | 5/2007 | Tamaki et al. | 206/521 |

FOREIGN PATENT DOCUMENTS

| | | | |
|---|---|---|---|
| EP | 0075793 | A1 | 4/1983 |
| JP | 61-181397 | U | 11/1986 |

(Continued)

OTHER PUBLICATIONS

International Search Report of PCT/JP2009/064805, mailing date Nov. 17, 2009.

(Continued)

*Primary Examiner* — Timothy A Brainard
(74) *Attorney, Agent, or Firm* — Westerman, Hattori, Daniels & Adrian, LLP

(57) ABSTRACT

A fuel assembly 20 is constituted by combining a plurality of fuel rods 21, holding the fuel rods 21 by a plurality of support grids 22, and arranging a lower nozzle 24 and an upper nozzle 23 at opposite ends of the fuel rods 21. A shock-absorbing device 10 for a fuel assembly is fitted to the lower nozzle 24 and the upper nozzle 23. The shock-absorbing device 10 for a fuel assembly is constituted a nozzle support 12 fitted to a depression 24U of the lower nozzle 24 and a depression 23U of the upper nozzle 23, and a buffer 11 combined with the nozzle support 12, with stiffness thereof in a longitudinal direction of the fuel rods 21 being equal to or lower than that of the nozzle support 12.

11 Claims, 13 Drawing Sheets

(51) Int. Cl.
*G21F 5/08* (2006.01)
*G21F 9/36* (2006.01)

(56) References Cited

FOREIGN PATENT DOCUMENTS

| | | | | |
|---|---|---|---|---|
| JP | 06094872 | A | * | 4/1994 |
| JP | 6-76898 | U | | 10/1994 |
| JP | 2002-341085 | A | | 11/2002 |
| JP | 2003-207594 | A | | 7/2003 |
| JP | 3600551 | B2 | | 12/2004 |

OTHER PUBLICATIONS

Written Opinion of the International Searching Authority, issued in corresponding International Application No. PCT/JP2009/064805.
Extended European Search Report dated Oct. 13, 2014, issued in corresponding EP application No. 09828919.2 (6 pages).

* cited by examiner

SHOCK-ABSORBING DEVICE FOR FUEL ASSEMBLY AND FUEL ASSEMBLY HOUSING CONTAINER

FIELD

The present invention relates to transport of a fuel assembly used in a nuclear reactor.

BACKGROUND

An assembly of nuclear fuel used in a nuclear power plant or the like is referred to as "fuel assembly". A fuel assembly loaded in a nuclear reactor, burned for a predetermined period, and taken out from the nuclear reactor contains fission products (FP). Therefore, the fuel assembly is normally cooled in a cooling pit of a nuclear power plant or the like for a predetermined period. Thereafter, the fuel assembly is housed in a fuel assembly housing container having a radiation shielding function, transported to processing facilities or interim storage facilities by a vehicle or a ship, and stored at the facilities until reprocessing is performed. Patent Literature 1 discloses a buffer member positioned in a radial direction gap between a radioactive material assembly and a basket, and a spacer positioned in an axial direction gap between the radioactive material assembly and a lid.

CITATION LIST

Patent Literature

Patent Literature 1: Japanese Patent No. 3600551 (paragraph 0006, FIG. 8, and FIG. 11)

SUMMARY

Technical Problem

A fuel assembly includes a nozzle having a plurality of legs (normally, four) at opposite ends of a plurality of fuel rods. However, when a transporting cask that houses the fuel assembly drops vertically, that is, the fuel assembly drops with its longitudinal direction being a vertical direction, the nozzle may be bent and deformed. In this case, there is a risk that the fuel assembly is deformed due to the deformation of the nozzle. Therefore, an object of the present invention is to suppress deformation of a fuel assembly at the time of dropping.

Solution to Problem

According to an aspect of the present invention, a shock-absorbing device for a fuel assembly that suppresses a shock given to a fuel assembly constituted by combining a plurality of fuel rods and arranging a first nozzle and a second nozzle at opposite ends of the fuel rods includes: a nozzle support fitted to a depression of the first nozzle; and a buffer combined with the nozzle support, with stiffness of the fuel rods in a longitudinal direction being equal to or less than that of the nozzle support.

The shock-absorbing device for a fuel assembly supports the first nozzle of the fuel assembly by the nozzle support to suppress flexure of the first nozzle resulting from an impact force due to dropping. Further, the impact force acting on the fuel assembly is absorbed by the buffer. With this configuration, deformation of the first nozzle due to dropping can be suppressed, thereby suppressing deformation of the fuel rods caused by the deformation of the first nozzle. Further, because the impact force acting on the fuel assembly is weakened, deformation of the fuel assembly is suppressed. Due to these effects, the present invention can suppress deformation of the fuel assembly at the time of dropping. In the nozzle support fitted to the depression, and the buffer combined with the nozzle support and having a stiffness of the fuel rod in a longitudinal direction equal to or less than that of the nozzle support, it can be selected whether the second nozzle is not combined with any of these, is combined only with the buffer, or is combined with the nozzle support and the buffer.

According to an aspect of the present invention, a shock-absorbing device for a fuel assembly that suppresses a shock given to a fuel assembly constituted by combining a plurality of fuel rods and arranging a first nozzle and a second nozzle at opposite ends of the fuel rods includes: a nozzle support fitted to a depression of the first nozzle; and a buffer combined with the nozzle support, with stiffness of the fuel rods combined with the first nozzle and the second nozzle in a longitudinal direction being equal to or less than that of the nozzle support.

The shock-absorbing device for a fuel assembly supports the first nozzle of the fuel assembly by the nozzle support to suppress flexure of the first nozzle resulting from an impact force due to dropping. Further, the impact force acting on the fuel assembly is absorbed by the buffer. With this configuration, deformation of the first nozzle or second nozzle caused by dropping can be suppressed, thereby suppressing deformation of the fuel rods resulting from the deformation. Further, because the impact force acting on the fuel assembly is weakened by the buffer, deformation of the fuel assembly can be suppressed. Due to these effects, the present invention can suppress deformation of the fuel assembly at the time of dropping.

According to an aspect of the present invention, a shock-absorbing device for a fuel assembly that suppresses a shock given to a fuel assembly constituted by combining a plurality of fuel rods and arranging a first nozzle and a second nozzle at opposite ends of the fuel rods includes: a nozzle support fitted to a depression of the first nozzle and a depression of the second nozzle; and a buffer combined with the nozzle support, with stiffness of the fuel rods in a longitudinal direction being equal to or less than that of the nozzle support.

The shock-absorbing device for a fuel assembly supports the first and second nozzles of the fuel assembly by the nozzle support to suppress flexure of the first and second nozzles resulting from an impact force due to dropping. Further, the impact force acting on the fuel assembly is absorbed by the buffer. With this configuration, deformation of the first and second nozzles caused by dropping can be suppressed, thereby suppressing deformation of the fuel rods resulting from the deformation. Further, because the impact force acting on the fuel assembly is weakened by the buffer, deformation of the fuel assembly can be suppressed. Due to these effects, the present invention can suppress deformation of the fuel assembly at the time of dropping.

As a desirable mode of the present invention, in the shock-absorbing device for a fuel assembly, it is preferable that the buffer is constituted by enclosing at least one of resin, wood, and honeycomb by a casing. The configuration of the buffer is formed of a board, a honeycomb structure, a laminated structure, foam, or wool, and a plurality of these can be combined. For example, a wood laminated material is covered with a metal plate to form the buffer. Accordingly, the buffer can be formed relatively easily.

As a desirable mode of the present invention, in the shock-absorbing device for a fuel assembly, it is preferable that the buffer includes a plurality of plate materials, and board surfaces of the plate materials are parallel to a longitudinal direction of the fuel rods. With this configuration, stiffness of the buffer can be adjusted relatively easily by adjusting the number, height and the like of the plate materials.

As a desirable mode of the present invention, in the shock-absorbing device for a fuel assembly, it is preferable that the buffer includes a plurality of rod-like members, and an axial direction of the rod-like members is parallel to a longitudinal direction of the fuel rods. With this configuration, stiffness of the buffer can be adjusted relatively easily by adjusting the number, height and the like of the rod-like members.

As a desirable mode of the present invention, in the shock-absorbing device for a fuel assembly, it is preferable that the first nozzle is arranged on a side of a bottom of a fuel assembly housing container for transporting the fuel assembly, and the buffer on the side of the first nozzle is arranged on the bottom of the fuel assembly housing container. With this configuration, the shock-absorbing device for a fuel assembly does not need to be fitted to the fuel assembly before housing the fuel assembly in the fuel assembly housing container. Therefore, the work efficiency for loading the fuel assembly in the fuel assembly housing container is improved.

As a desirable mode of the present invention, in the shock-absorbing device for a fuel assembly, it is preferable that the first nozzle is arranged on the bottom side of the fuel assembly housing container for transporting the fuel assembly, and the buffer on the first nozzle side is combined with a basket arranged inside the fuel assembly housing container to house the fuel assembly and arranged on the bottom side of the fuel assembly housing container. With this configuration, the shock-absorbing device for a fuel assembly does not need to be fitted to the fuel assembly before housing the fuel assembly in the fuel assembly housing container. Therefore, the work efficiency for loading the fuel assembly in the fuel assembly housing container is improved. Further, the shock-absorbing device for a fuel assembly can be fitted to the basket at the time of assembling the basket and the basket can be incorporated in the fuel assembly housing container. Therefore, the shock-absorbing device for a fuel assembly does not need to be laid on the bottom inside the fuel assembly housing container. Accordingly, a work for incorporating the shock-absorbing device for a fuel assembly in the fuel assembly housing container is facilitated.

As a desirable mode of the present invention, in the shock-absorbing device for a fuel assembly, it is preferable that the second nozzle is arranged at the opening of the fuel assembly housing container for transporting the fuel assembly, and the buffer on the second nozzle side is arranged on the lid of the fuel assembly housing container for transporting the fuel assembly. With this configuration, the shock-absorbing device can be combined with the second nozzle of the fuel assembly only by fitting the lid after the fuel assembly has been loaded in the fuel assembly housing container.

In the present invention, it is preferable in a shock absorber for a fuel assembly that the shock absorber optimizes nozzle-deformation suppression capabilities by the nozzle support and shock absorbing capacity by the buffer. For example, buffering capacity of the buffer coming into contact with the nozzle support is optimized more than that of the buffer coming into contact with nozzle legs by selecting the thickness, material, laminated constitution, dividing arrangement and the like of the buffer. Accordingly, the nozzle-deformation suppression capabilities and shock buffering capacity can be balanced by setting an amount of compression of the buffer that absorbs shock and deforms due to a load of the nozzle legs on the buffer and a load of a nozzle plane on the buffer through the nozzle support substantially equal. With this configuration, it can be prevented that the nozzle deforms in a convex shape, if the amount of compression of the buffer by the nozzle legs is larger than that of the buffer by the nozzle support, and the nozzle deforms in a concave shape, if the amount of compression of the buffer by the nozzle legs is smaller than that of the buffer by the nozzle support.

To solve the above problems and achieve an object of the invention, a fuel assembly housing container according to the present invention includes a body that is a container with a bottom and houses a fuel assembly in an internal space thereof; and a shock-absorbing device for a fuel assembly arranged at least on the bottom of the body. Because the fuel assembly housing container includes the shock-absorbing device for a fuel assembly according to the present invention, deformation of the fuel assembly at the time of dropping can be suppressed.

As a desirable mode of the present invention, it is preferable that the shock-absorbing device for a fuel assembly is arranged on a lid fitted to an opening of the internal space. In this manner, the fuel assembly is housed in the fuel assembly housing container, and in the fuel assembly housing container, the buffer of the shock-absorbing device for a fuel assembly according to the present invention is installed, respectively, in contact with the first and second nozzles of the fuel assembly. With this configuration, deformation of the fuel assembly at the time of dropping can be suppressed more effectively.

Advantageous Effects of Invention

The present invention can suppress deformation of a fuel assembly at the time of dropping.

DESCRIPTION OF EMBODIMENTS

The present invention will be explained below in detail with reference to the accompanying drawings. The present invention is not limited to the following explanations. In addition, constituent elements in the following explanations include those that can be easily assumed by persons skilled in the art or that are substantially equivalent. A shock-absorbing device for a fuel assembly according to the present invention is suitable for a fuel assembly of a PWR (Pressurized Water Reactor). However, application of the present invention to a BWR (Boiling Water Reactor) is not excluded. The shock-absorbing device for a fuel assembly according to the present invention is particularly suitable at the time of transporting the fuel assembly; however, application thereof at the time of storing the fuel assembly is not excluded. The shock-absorbing device for a fuel assembly according to the present invention can be applied not only to transport of the fuel assembly taken out from a nuclear reactor, but also to transport of a fuel assembly newly manufactured and loaded in a nuclear reactor.

Figure 1:
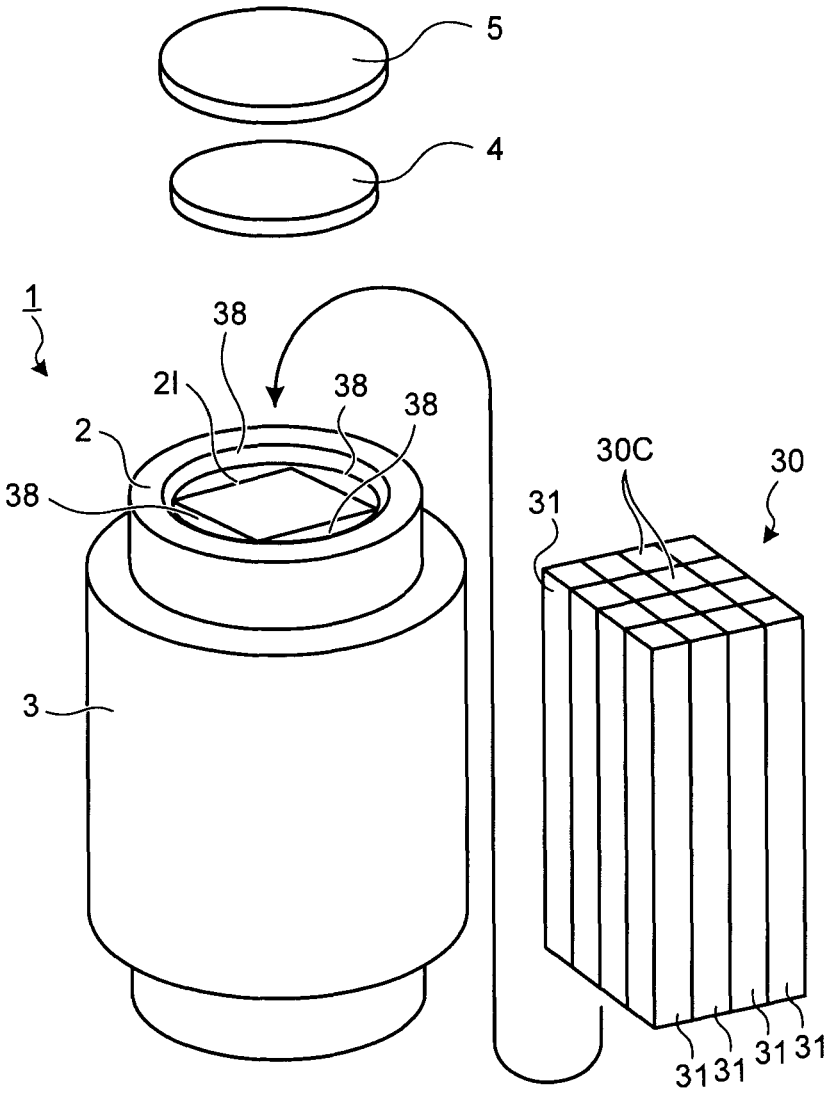
FIG. 1 is a schematic diagram of an overall configuration of a fuel assembly housing container that houses a fuel assembly.

FIG. 1 is a schematic diagram of an overall configuration of a fuel assembly housing container that houses a fuel assembly. A fuel assembly housing container 1 houses a fuel assembly taken out from the nuclear reactor, and is used for transport and storage of the fuel assembly. The fuel assembly housing container 1 includes a body 2, which is a container with a bottom, a neutron shield 3 fitted to outside of the body 2, a primary lid 4, and a secondary lid 5. The body 2 includes a cylindrical barrel, a bottom provided at one end of the barrel, and a space (also referred to as "internal space of the body", or "cavity") 2I formed by the body and the bottom becomes a space for housing the fuel assembly. The fuel assembly is stored in cells 30C of a basket 30 having a plurality of grid cells 30C. The basket 30 housing the fuel assembly is housed in the internal space 2I of the body 2 (the internal space of the body). In the present embodiment, the basket 30 is constituted by combining a plurality of square pipes 31 with an external shape and an inner shape in cross section being substantially regular tetragon, and the inside of the square pipe 31 becomes the cell 30C.

The body 2 has a function of shielding gamma rays from the fuel assembly housed in the internal space 2I of the body. The neutron shield 3 is provided therein with a neutron shielding material for shielding neutrons. A spacer 38 is arranged between the internal space 2I of the body and the basket 30. The spacer 38 transmits decay heat from the fuel assembly housed in the basket 30 to the body 2. The decay heat is released to the atmosphere via the body 2 and the neutron shield 3. After the fuel assembly is housed in the basket 30 (that is, after the fuel assembly is housed in the internal space 2I of the body), the primary lid (the lid) 4 is fitted to an opening of the internal space 2I of the body, and then the secondary lid 5 is fitted thereto to seal the internal space 2I of the body. A tertiary lid can be provided according to specifications. When the primary lid 4 and the secondary lid 5 are not distinguished from each other, these are referred to as "lid".

Figure 2:
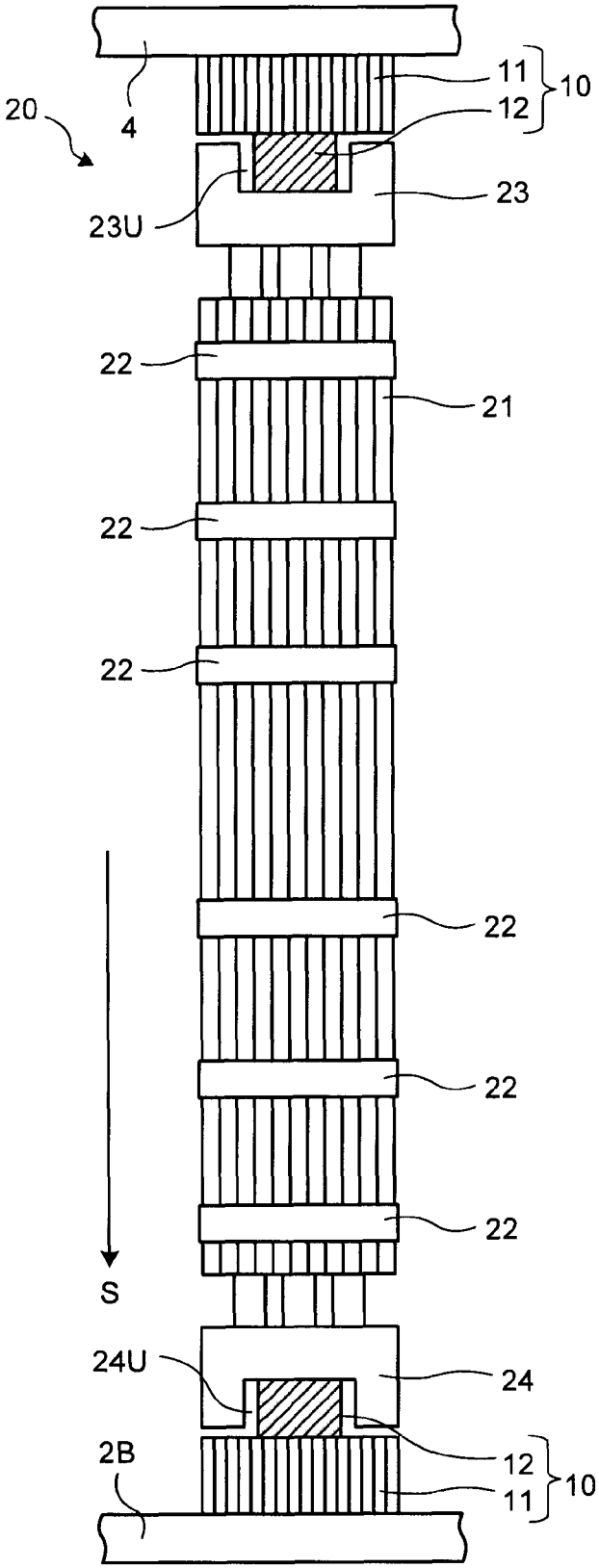
FIG. 2 is an explanatory diagram of a fuel assembly and a shock-absorbing device for a fuel assembly according to an embodiment of the present invention.

FIG. 2 is an explanatory diagram of a fuel assembly and the shock-absorbing device for a fuel assembly according to the present embodiment. A fuel assembly 20 is constituted by bundling a plurality of fuel rods 21 by a plurality of support grids 22. A lower nozzle (first nozzle) 24 and an upper nozzle (second nozzle) 23 are respectively arranged at opposite ends of the fuel rods 21. In a state where the fuel assembly 20 is housed inside of the fuel assembly housing container 1 shown in FIG. 1, the lower nozzle 24 is on a side of a bottom 2B of the body 2, and the upper nozzle 23 is on the primary lid 4 side (on an opening side of the fuel assembly housing container 1, that is, an opening side of the internal space 2I of the body). When the fuel assembly 20 is arranged in the nuclear reactor, the lower nozzle 24 is arranged on a vertical direction side, and the upper nozzle 23 is arranged on the opposite side in the vertical direction.

Figure 3A:
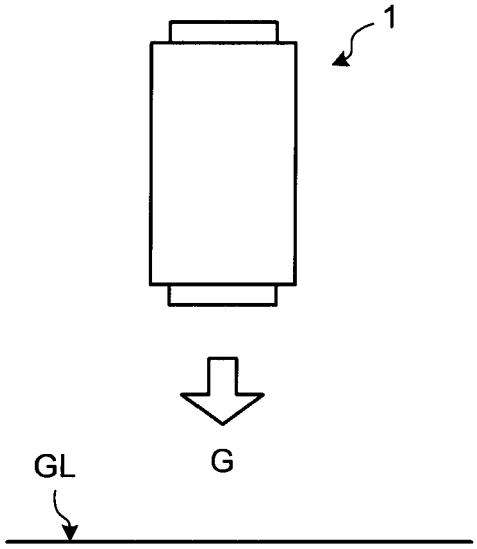
FIG. 3A depicts a state where the fuel assembly housing container vertically drops.
Figure 3B:
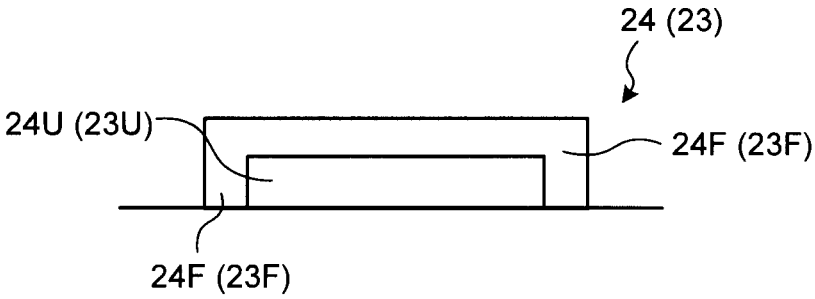
FIG. 3B is a schematic diagram of a shape of a lower nozzle at normal times.
Figure 3C:
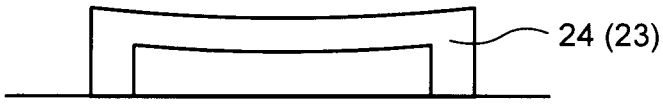
FIG. 3C is a schematic diagram of a shape of the lower nozzle when the fuel assembly housing container vertically drops.

FIG. 3A depicts a state where the fuel assembly housing container vertically drops. FIG. 3B is a schematic diagram of a shape of the lower nozzle at normal times. FIG. 3C is a schematic diagram of a shape of the lower nozzle when the fuel assembly housing container vertically drops. As shown in FIG. 3A, a state where the lid or bottom of the fuel assembly housing container 1 drops on the ground GL in the vertical direction (a direction shown by an arrow G in FIG. 3A) is referred to as "vertical drop". In the case of vertical drop, an impact load of the fuel assembly 20 in a direction substantially parallel to a longitudinal direction (a direction shown by an arrow S in FIG. 2) acts on the fuel assembly 20.

The lower nozzle 24 is normally in a non-deformation state as shown in FIG. 3B. The lower nozzle 24 (same as the upper nozzle 23) is substantially in a shape of regular tetragon as viewed in a plan view, and supports the fuel assembly 20 by a plurality of (specifically, four) legs 24F (23F) respectively provided at four corners. Accordingly, a depression 24U (23U) is formed in a portion surrounded by the four legs.

Therefore, if the fuel assembly housing container 1 vertically drops and an impact force in a substantially parallel direction to the longitudinal direction of the fuel assembly 20 acts on the fuel assembly 20, as shown in FIG. 3C, the center of the lower nozzle 24 (the upper nozzle 23) may be bent. If the lower nozzle 24 (the upper nozzle 23) is bent, the fuel rod 21 shown in FIG. 2 may be deformed accompanying this. Therefore, in the present embodiment, the shock-absorbing device for a fuel assembly (hereinafter, "shock-absorbing device") 10 is fitted to the lower nozzle 24 (the upper nozzle 23) to suppress flexure (deformation) of the lower nozzle 24 (the upper nozzle 23) and suppress an impact force generated due to dropping and acting on the fuel assembly 20.

Figure 4:
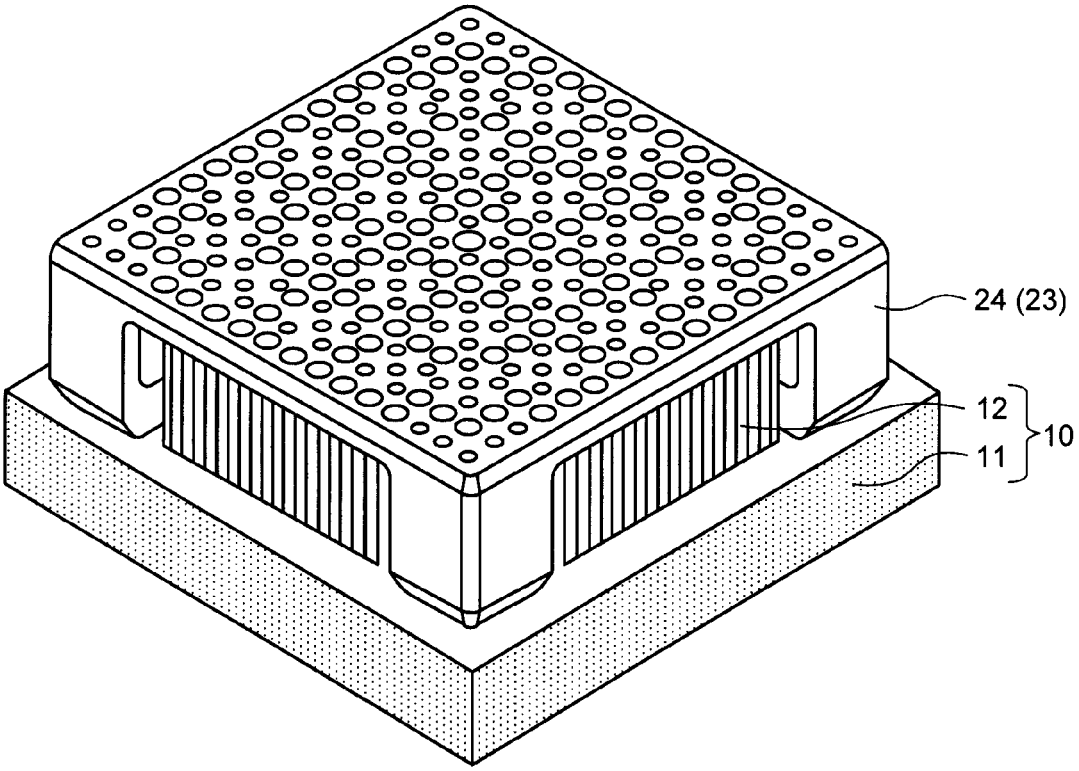
FIG. 4 is a perspective view of the shock-absorbing device according to the embodiment.

FIG. 4 is a perspective view of the shock-absorbing device according to the present embodiment. As shown in FIGS. 4 and 1, the shock-absorbing device 10 includes a nozzle support 12, and a buffer 11. The nozzle support 12 is fitted to the depression 24U of the lower nozzle 24 and the depression 23U of the upper nozzle 23. The buffer 11 is combined with the nozzle support 12, and stiffness thereof in the longitudinal direction of the fuel rods 21 constituting the fuel assembly 20 is equal to or lower than that of the nozzle support 12. The stiffness here is compression stiffness as the entire buffer 11 and nozzle support 12. That is, when the buffer 11 and the nozzle support 12 receive a compression force parallel to the longitudinal direction of the fuel rods 21, if the compression force is the same, the buffer 11 deforms similarly to the nozzle support 12, or deforms greater than the nozzle support 12.

According to such a configuration, the shock-absorbing device 10 supports the lower nozzle 24 (the upper nozzle 23) by the nozzle support 12, and suppresses flexure of the lower nozzle 24 (the upper nozzle 23) resulting from the impact force due to dropping. The impact force acting on the fuel assembly 20 is absorbed by the buffer 11. With this configuration, because deformation of the lower nozzle 24 (the upper nozzle 23) due to dropping can be suppressed, deformation of the fuel rods 21 due to the deformation of the lower nozzle 24 (the upper nozzle 23) can be suppressed. The impact force acting on the fuel assembly 20 is weakened by the buffer 11. As a result, because the deformation of the fuel assembly 20 is further suppressed, its safety is improved.

In the present embodiment, the shock-absorbing device 10 is provided respectively in both of the lower nozzle 24 and the upper nozzle 23. With this configuration, a clearance between the fuel assembly 20 housed in the fuel assembly housing container 1 and the fuel assembly housing container 1 in the longitudinal direction can be decreased. As a result, because a movement of the fuel assembly 20 in the longitudinal direction is suppressed, when the fuel assembly housing container 1 is grounded at the time of dropping, a movement of the fuel assembly 20 toward the ground can be suppressed. With this configuration, the impact force acting on the fuel assembly 20 can be further weakened.

The upper nozzle 23 is positioned on the side of the primary and secondary lids 4 and 5. When the fuel assembly housing container 1 drops with the primary lid 4 and the secondary lid 5 being downward, the impact force due to the dropping is transmitted from the upper nozzle 23 to the primary lid 4. In the present embodiment, because the shock-absorbing device 10 is provided in the upper nozzle 23, the impact force transmitted from the upper nozzle 23 is weakened by the shock-absorbing device 10, thereby enabling to maintain sealing by the primary lid 4. In view of further weakening the impact force transmitted from the upper nozzle 23 to the primary lid 4, it is preferable that the buffer 11 of the shock-absorbing device 10 provided in the upper nozzle 23 can absorb larger impact energy than the buffer 11 provided in the lower nozzle 24.

Figure 5A:
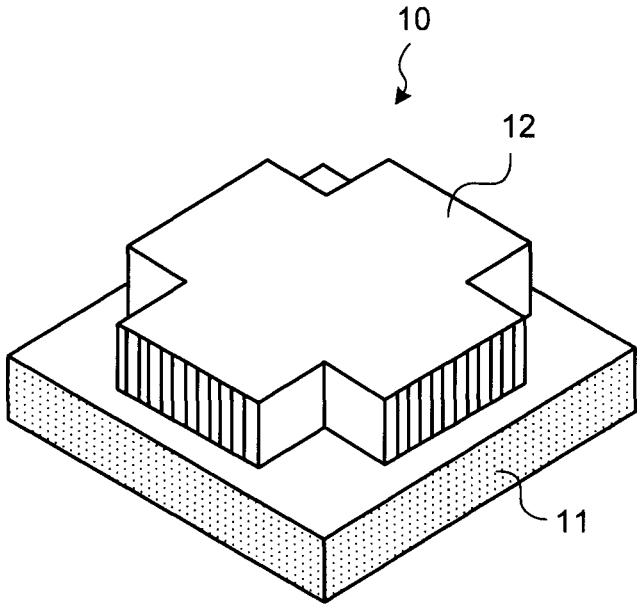
FIG. 5A is a perspective view of a nozzle support constituting the shock-absorbing device according to the embodiment.

FIG. 5A is a perspective view of the nozzle support constituting the shock-absorbing device according to the present embodiment. As shown in FIG. 5A, the nozzle support 12 constituting the shock-absorbing device 10 is placed on the buffer 11. The nozzle support 12 is a plate like member with four corners of a regular tetragon being removed as viewed in a plan view. With this configuration, as shown in FIG. 4, when the nozzle support 12 is fitted to the lower nozzle 24 (the upper nozzle 23), the four legs of the lower nozzle 24 (the upper nozzle 23) and the nozzle support 12 do not interference with each other.

It is preferable that the nozzle support 12 has compression stiffness as high as possible in a direction where a load due to vertical drop is input (a direction orthogonal to a plate surface of the nozzle support 12). Therefore, the nozzle support 12 is constituted by using a material strong against compression or a structure strong against compression, or by combining the both. For example, stainless steel, iron, aluminum, aluminum alloy, lead, or concrete are used for the nozzle support 12. When using these materials, it is preferable that the nozzle support 12 is solid. With this configuration, the nozzle support 12 can ensure higher compression stiffness. When a material having a radiation shielding function such as iron, aluminum alloy containing boron ($B^{10}$), stainless steel, lead, or concrete is used, gamma rays and neutrons discharged from the fuel assembly 20 can be shielded, which is more preferable.

Figure 5B:
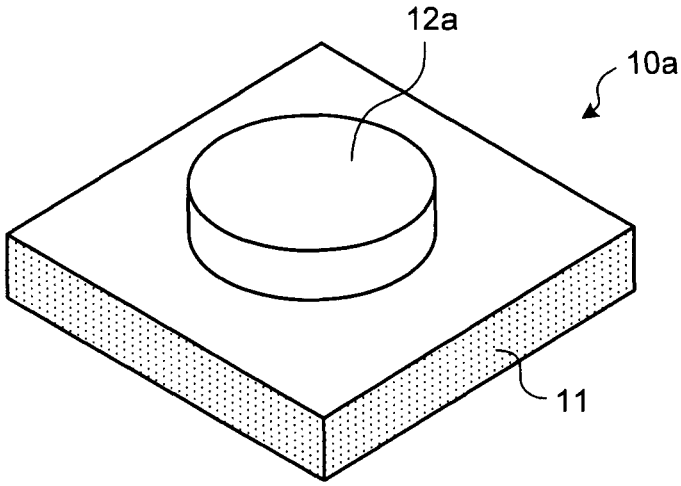
FIG. 5B is a perspective view of another configuration example of the nozzle support according to the embodiment.
Figure 5C:
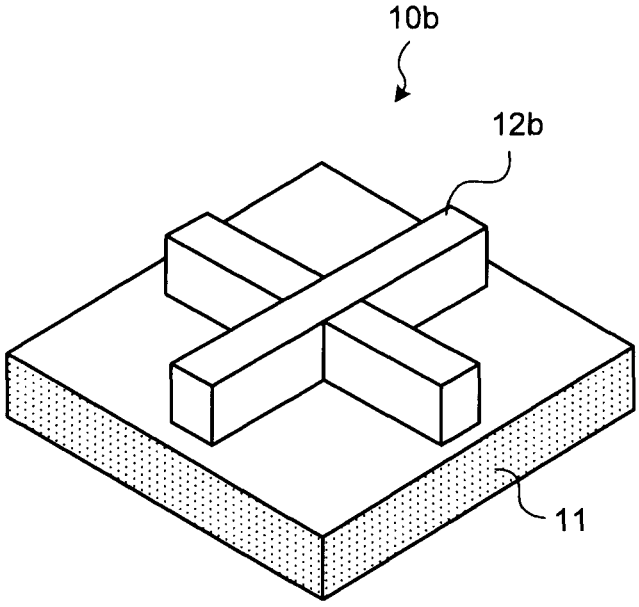
FIG. 5C is a perspective view of another configuration example of the nozzle support according to the embodiment.
Figure 5D:
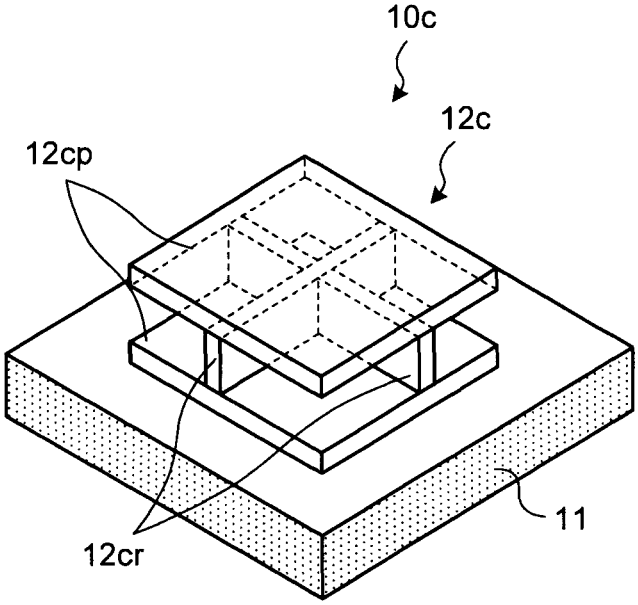
FIG. 5D is a perspective view of another configuration example of the nozzle support according to the embodiment.

FIGS. 5B to 5D are perspective views of other configuration examples of the nozzle support according to the present embodiment. As in a shock-absorbing device 10*a* shown in FIG. 5B, a disk-like nozzle support 12*a* can be used, or as in a shock-absorbing device 10*b* shown in FIG. 5C, a nozzle support 12*b* having a cruciform shape as viewed in a plan view can be used. As in a shock-absorbing device 10*c* shown in FIG. 5D, ribs 12*cr* combined to have a cruciform shape as viewed in a plan view are clamped by using two flat plates 12*cp* so that the ribs 12*cr* and the flat plates 12*cp* are orthogonal to each other, to constitute the nozzle support 12*c*. Because the nozzle support 12*c* improves the compression stiffness by the structure thereof, the material constituting the nozzle support 12*c* can be less. As a result, reduction of material cost and weight saving can be realized.

Figure 6A:
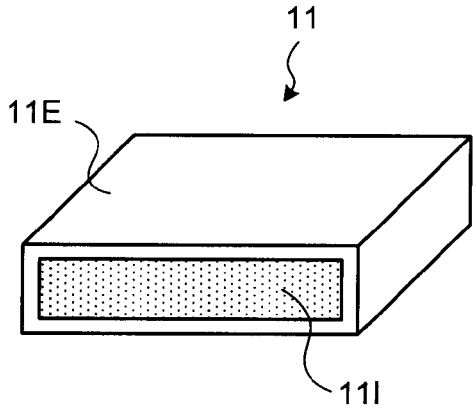
FIG. 6A is a perspective view of a buffer constituting the shock-absorbing device according to the embodiment.

FIG. 6A is a perspective view of the buffer constituting the shock-absorbing device according to the present embodiment. In the present embodiment, the buffer 11 has a square shape as viewed in a plan view, and compression stiffness thereof in a direction where the load due to vertical drop is input (a direction orthogonal to the plate surface of the nozzle support 12) is equal to or lower than the nozzle support 12. The shape of the buffer 11 is not limited to the square shape. The buffer 11 is formed by a plate member, a honeycomb structure, a laminated structure, foam, or wool, and a plurality of these can be combined.

The buffer 11 is constituted by surrounding a buffer member 11I, for example, by a casing 11E, which is a holding member. Note that the casing 11E is not always necessary. The buffer member 11I is constituted, for example, by using any one of resin, wood, and metal, or combining at least two of these materials. The casing 11E is constituted by combining an iron board or a stainless steel board, for example.

When resin is used for the buffer member 11I, it is preferable to use hydrogen-containing resin, for example. This is because a neutron shielding function can be demonstrated by using such resin. When a honeycomb is used for the buffer member 11I, it is preferable that a penetrating direction of holes is parallel to a direction where the load due to vertical drop is input. With this configuration, the compression stiffness of the buffer 11 can be adjusted to be appropriate. In the present embodiment, the honeycomb includes one obtained by combining a plurality of polygonal holes such as hexagonal holes, pentagonal holes, or quadrangular holes, other than one obtained by combining a plurality of regular hexagonal holes. When wood is used for the buffer member 11I, it is preferable that a fiber direction of wood is parallel to a direction where the load due to vertical drop is input. With this configuration, the compression stiffness of the buffer 11 can be adjusted to be appropriate. The compression stiffness of the buffer 11 can be adjusted by differentiating the fiber direction of wood.

Figure 6B:
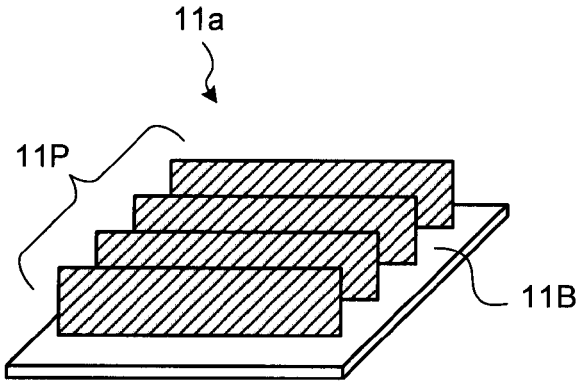
FIG. 6B is a perspective view of another configuration example of the buffer according to the embodiment.
Figure 6C:
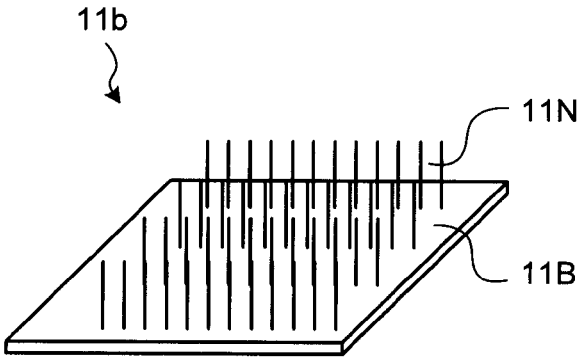
FIG. 6C is a perspective view of another configuration example of the buffer according to the embodiment.

FIGS. 6B and 6C are perspective views of other configuration examples of the buffer according to the present embodiment. A buffer 11*a* shown in FIG. 6B includes a plurality of plate materials 11P, and the plate materials 11P are arranged such that plate surfaces thereof are parallel to a direction where the load due to vertical drop is input, that is, parallel to the longitudinal direction of the fuel rods 21. In this example, a plurality of plate materials 11P are fitted to a bottom plate 11B orthogonally thereto. The compression stiffness of the buffer 11*a* can be adjusted according to the number, thickness, and height of the plate materials 11P. The plate material 11P is not limited to the one with the plate surface being parallel to the longitudinal direction of the fuel rods 21, and for example, the plate surface can be inclined with respect to the longitudinal direction of the fuel rods 21, or the plate material 11P can have a curved portion (for example, a cross section of the plate material 11P is in a dog-leg shape).

A buffer 11*b* shown in FIG. 6C includes a plurality of rod-like members 11N and the rod-like members 11N are arranged with an axial direction being parallel to the longitudinal direction of the fuel rods. In this example, a plurality of rod-like members 11N are fitted to the bottom plate 11B orthogonally thereto. The compression stiffness of the buffer 11*b* can be adjusted according to the number, diameter, and height of the rod-like members 11N. The configuration of the buffer is not limited to the configuration described above, and for example, an elastic body such as a disc spring, a plate spring, or a helical spring can be used.

Figure 7A:
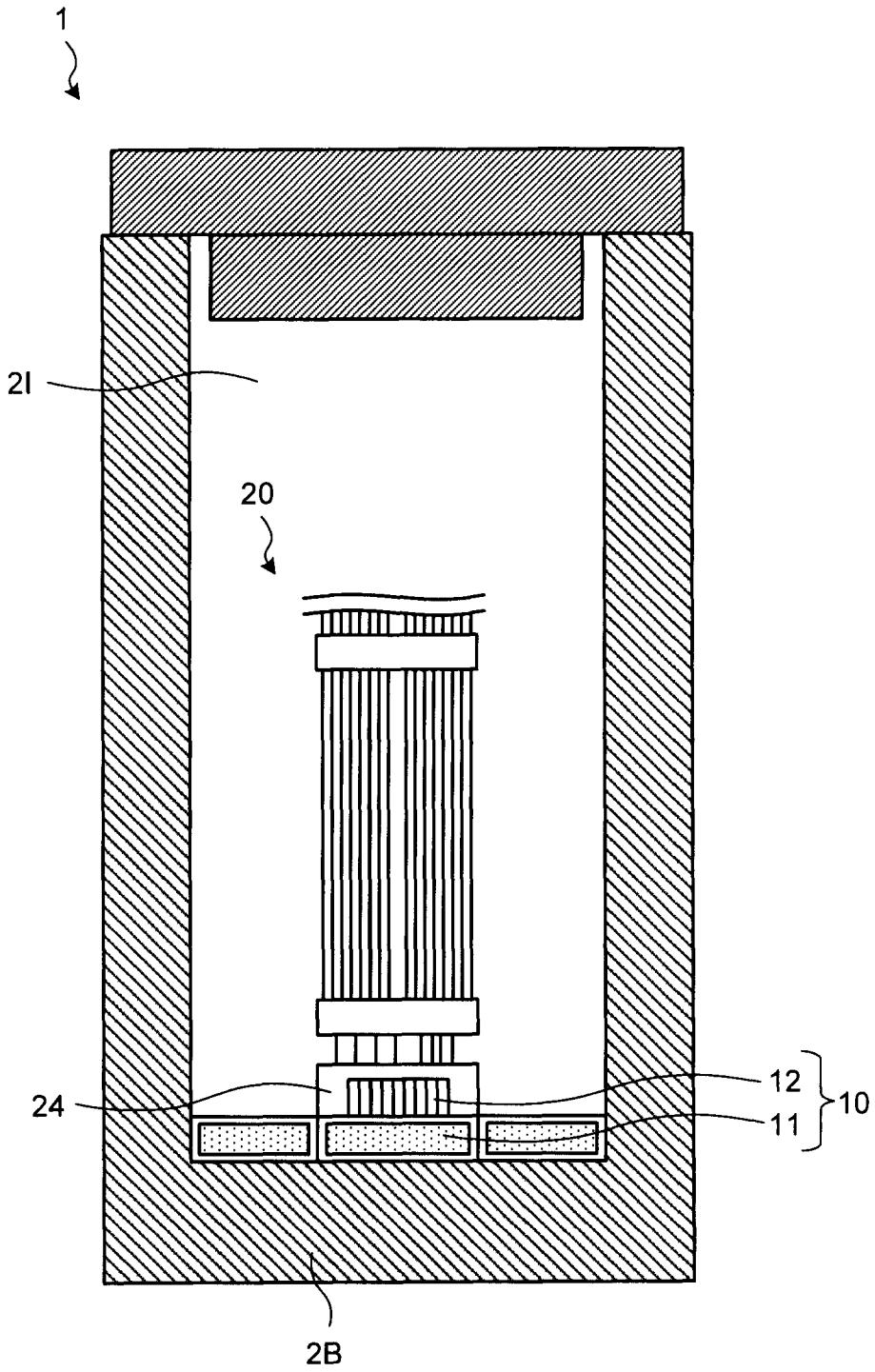
FIG. 7A is a schematic diagram of an example in which the shock-absorbing device according to the embodiment is fitted to a fuel assembly housing container.
Figure 7B:
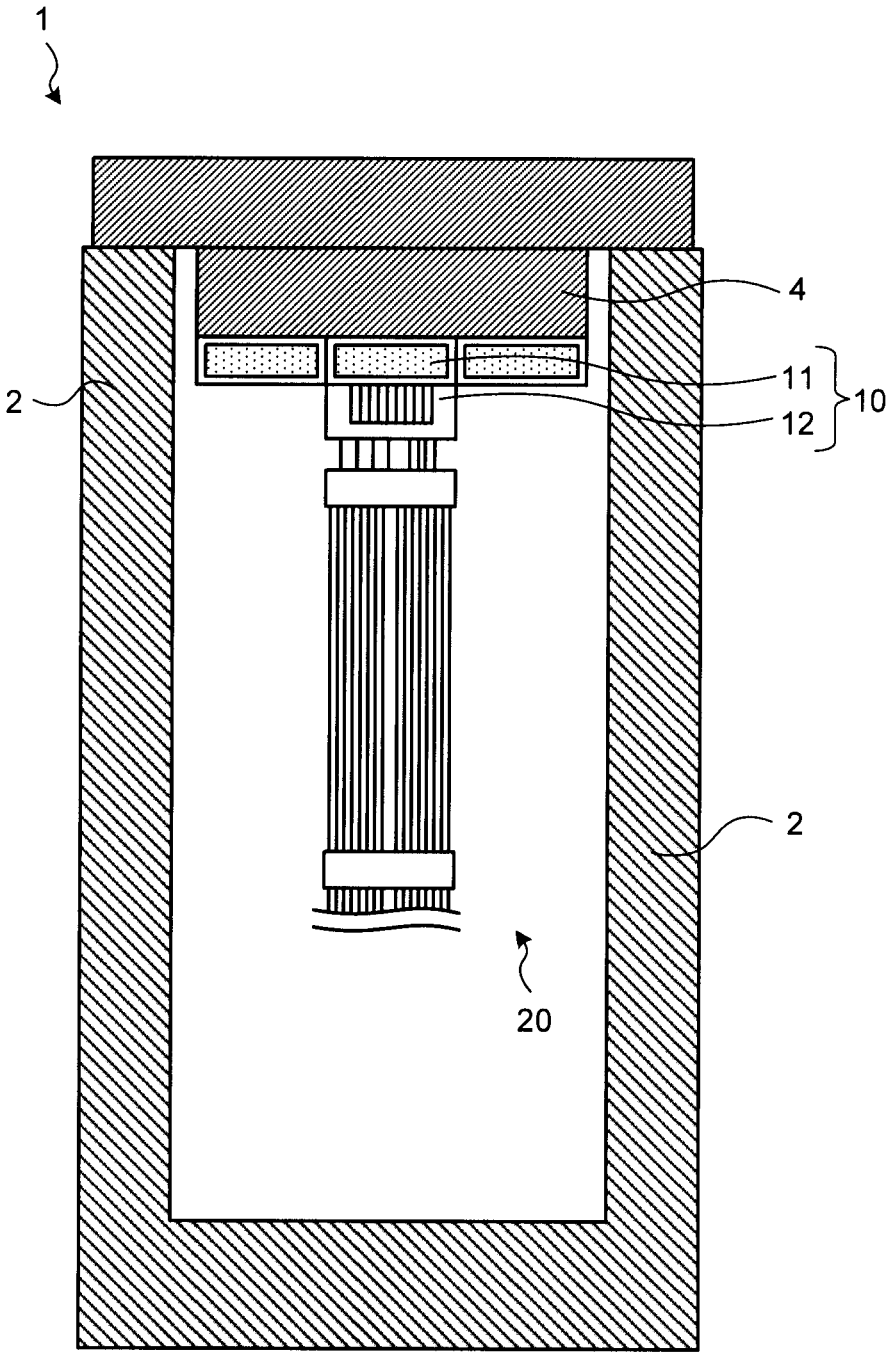
FIG. 7B is a schematic diagram of an example in which the shock-absorbing device according to the embodiment is fitted to a fuel assembly housing container.

FIGS. 7A and 7B are schematic diagrams of examples in which the shock-absorbing device according to the present embodiment is fitted to the fuel assembly housing container. In the example shown in FIG. 7A, the buffer 11 constituting the shock-absorbing device 10 on the lower nozzle 24 side is arranged on the bottom 2B of the fuel assembly housing container 1 for transporting the fuel assembly 20. In this case, before the basket 30 shown in FIG. 1 is arranged in the internal space 2I of the body, the shock-absorbing device 10 is laid on the bottom 2B beforehand. The position where the shock-absorbing device 10 is arranged is matched with the position of the cells 30C constituting the basket 30. With this configuration, the shock-absorbing device 10 can be fitted together with the lower nozzle 24 of the fuel assembly 20 only by loading the fuel assembly 20 in the basket 30.

In the example shown in FIG. 7B, the buffer 11 constituting the shock-absorbing device 10 on the upper nozzle 23 side is arranged on the lid, more specifically, the primary lid 4 of the fuel assembly housing container 1 for transporting the fuel assembly 20. In this case, the position where the shock-absorbing device 10 is arranged is matched with the position of the cells 30C constituting the basket 30. With this configuration, the shock-absorbing device 10 can be fitted together with the upper nozzle 23 of the fuel assembly 20 only by fitting the primary lid 4 to the body 2.

Figure 7C:
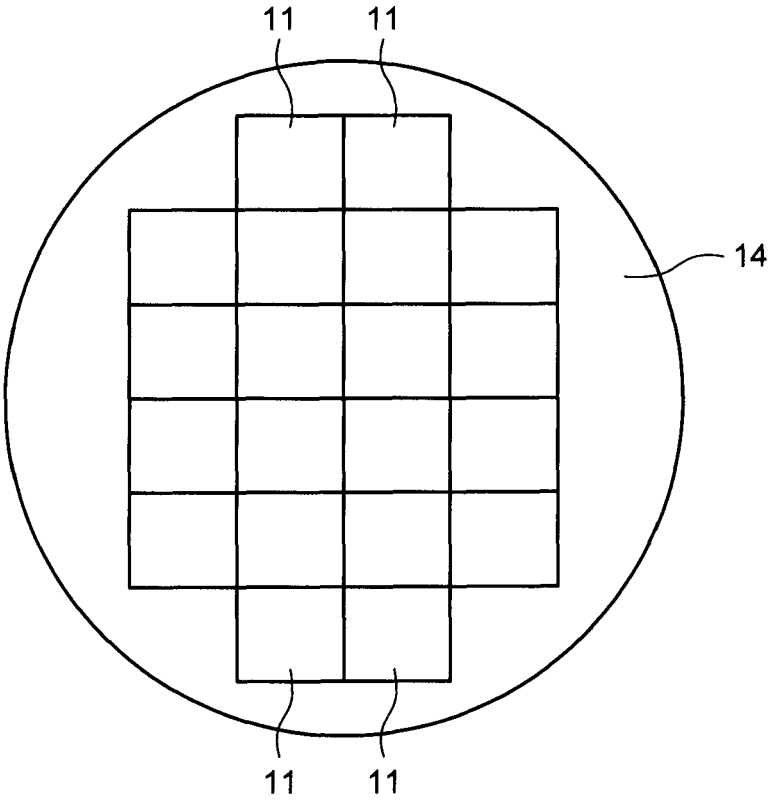
FIG. 7C is an example in which a plurality of buffers are arranged on a buffer support member.
Figure 7D:
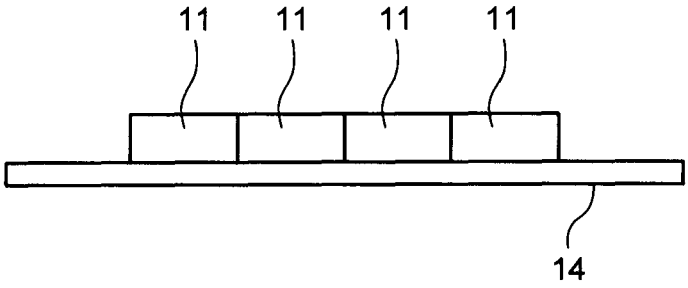
FIG. 7D is an example in which a plurality of buffers are arranged on a buffer support member.

FIGS. 7C and 7D are examples in which a plurality of buffers are arranged on a buffer support member. FIG. 7C is a plan view and FIG. 7D is a side view. Thus, a plurality of buffers 11 can be fitted to a disk 14, which is a buffer support member. The disk 14 fitted with the buffers 11 is arranged on the bottom of the body 2 of the fuel assembly housing container 1 shown in FIG. 1 or fitted to the primary lid 4. With this configuration, because the buffers 11 can be handled collectively, installation work of the buffers 11 is facilitated. The nozzle support 12 can be fitted to the buffers 11 and then fitted to the disk 14.

Figure 8A:
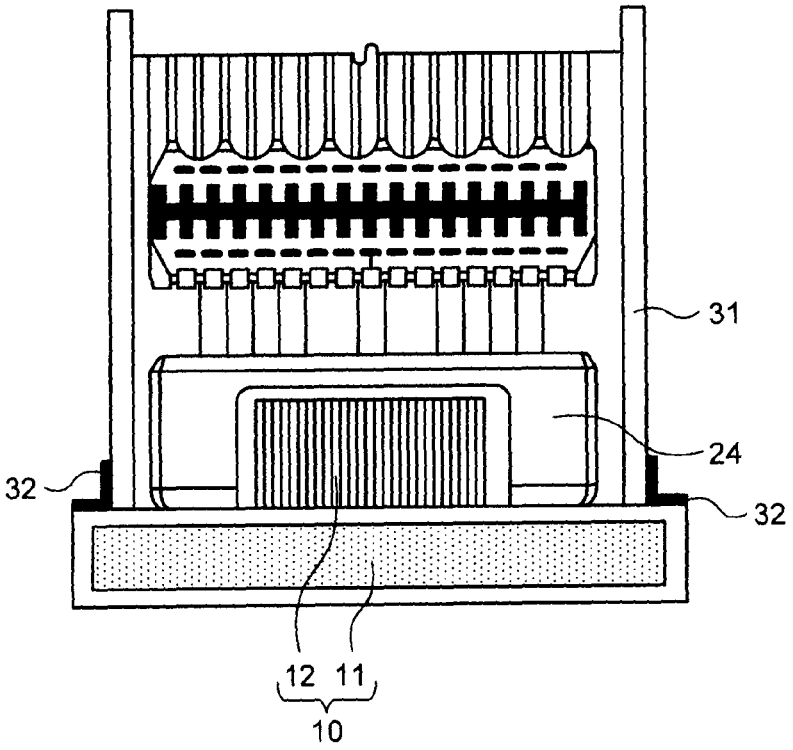
FIG. 8A is a schematic diagram of an example in which the shock-absorbing device according to the embodiment is fitted to a basket.
Figure 8B:
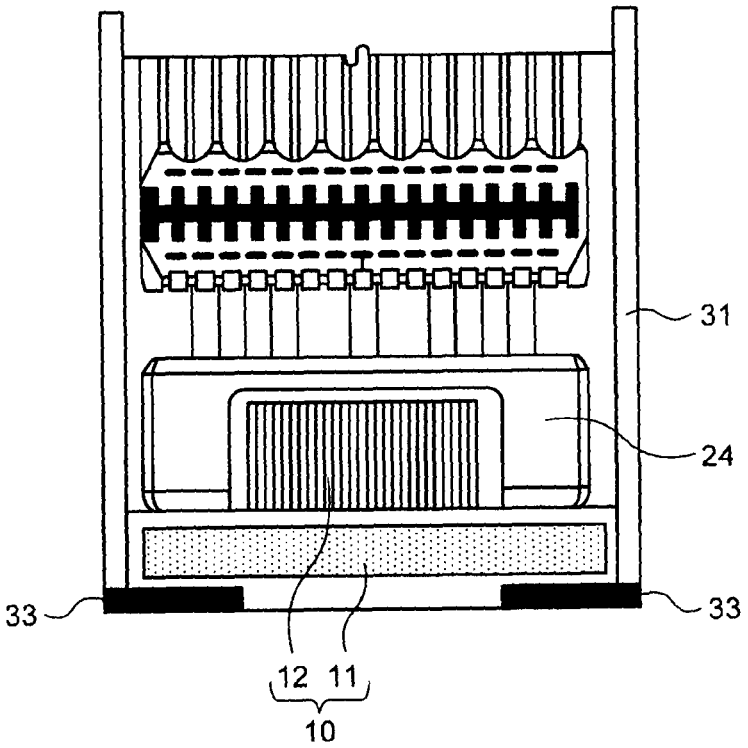
FIG. 8B is a schematic diagram of an example in which the shock-absorbing device according to the embodiment is fitted to a basket.

FIGS. 8A and 8B are schematic diagrams of examples in which the shock-absorbing device according to the present embodiment is fitted to a basket. In the example shown in FIG. 8A, the shock-absorbing device 10 is fitted to the basket 30 shown in FIG. 1. More specifically, the shock-absorbing device 10 is fitted to an end of the square pipe 31 constituting the basket 30 (an end on the bottom 2B side of the fuel assembly housing container 1). In this case, the buffer 11 and the square pipe 31 are connected via a coupling member 32, thereby fitting the shock-absorbing device 10 to the square pipe 31. The coupling member 32, the buffer 11, and the square pipe 31 are coupled with one another by a bolt, welding or the like. In the configuration shown in FIG. 8A, the buffer 11 projects from the square pipe 31. However, if a certain distance is required between respective square pipes 31, a projected portion of the buffer can be used as a spacer, and thus assembly of the basket 30 is facilitated. As an example in which a certain distance is required between respective square pipes 31, for example, when a neutron shield or a structure for shielding neutrons is arranged.

The example shown in FIG. 8B is identical to the example shown in FIG. 8A in that the shock-absorbing device 10 is fitted to an end of the square pipe 31 constituting the basket 30 (an end on the bottom 2B side of the fuel assembly housing container 1). However, an external shape and size of the buffer 11 of the shock-absorbing device 10 are set to be approximately the same as those of the square pipe 31, preferably, the same as those of the square pipe 31, or set to be smaller than those of the square pipe 31. The buffer 11 and the square pipe 31 are coupled with each other via a coupling member 33, and the shock-absorbing device 10 is fitted to the square pipe 31. In the example shown in FIG. 8B, because the buffer 11 does not project from the square pipe 31, this example is advantageous when it is desired that the square pipes 31 are arranged closely to each other.

As described above, by fitting the shock-absorbing device 10 to the basket 30 that houses the fuel assembly, the shock-absorbing device 10 can be fitted together with the upper nozzle 23 of the fuel assembly 20 only by loading the fuel assembly 20 in the basket 30. With this configuration, the shock-absorbing device 10 does not need to be fitted to the fuel assembly 20 before loading the fuel assembly 20 in the basket 30, thereby facilitating a loading work of the fuel assembly 20 in the basket 30. According to a mode of operations, the fuel assembly 20 can be loaded in the basket 30 after the shock-absorbing device 10 is fitted to the fuel assembly 20.

FIGS. 9A to 9D depict modifications of the shock-absorbing device according to the present embodiment. As an arrangement at the time of joining the nozzles (the lower nozzle and the upper nozzle) to the shock-absorbing device, it can be considered to design so that nozzle legs actually come into contact with the buffer. When the fuel assembly housing container drops in this state, if material characteristics of the buffer show a deformation behavior of an elastic body, deformation of the buffer becomes uniform over the entire range of the buffer, and the nozzle and the nozzle support do not come into contact with each other, and thus deformation of the nozzle may not be suppressed sufficiently.

Therefore, as shown in FIGS. 9A to 9D, the configuration of the buffer is changed or an inside structure of the buffer or a material thereof is devised, so that absorption of impact energy and the deformation of the nozzle become appropriate. In a shock-absorbing device 10*d* shown in FIG. 9A, a buffer 11*d* includes a first buffer 11A and the second buffer 11B. In this case, a depression is formed in the first buffer 11A, and the second buffer 11B is arranged in the depression. The first buffer 11A and the lower nozzle 24 (or the upper nozzle 23) are brought into contact with each other, and the second buffer 11B and the nozzle support 12 are brought into contact with each other. With this configuration, a timing of deformation of the first buffer 11A that comes into contact with the legs 24F (23F) of the lower nozzle 24 (or the upper nozzle 23) is made different from that of deformation of the second buffer 11B that comes into contact with the nozzle support 12. That is, the first buffer 11A that comes into contact with the legs 24F (23F) deforms until a gap between the lower nozzle 24 (or the upper nozzle 23) and the nozzle support 12 is filled, and at the timing when the gap is filled, the buffer 11*d*, that is both of the first buffer 11A and the second buffer 11B start to deform.

Figure 9A:
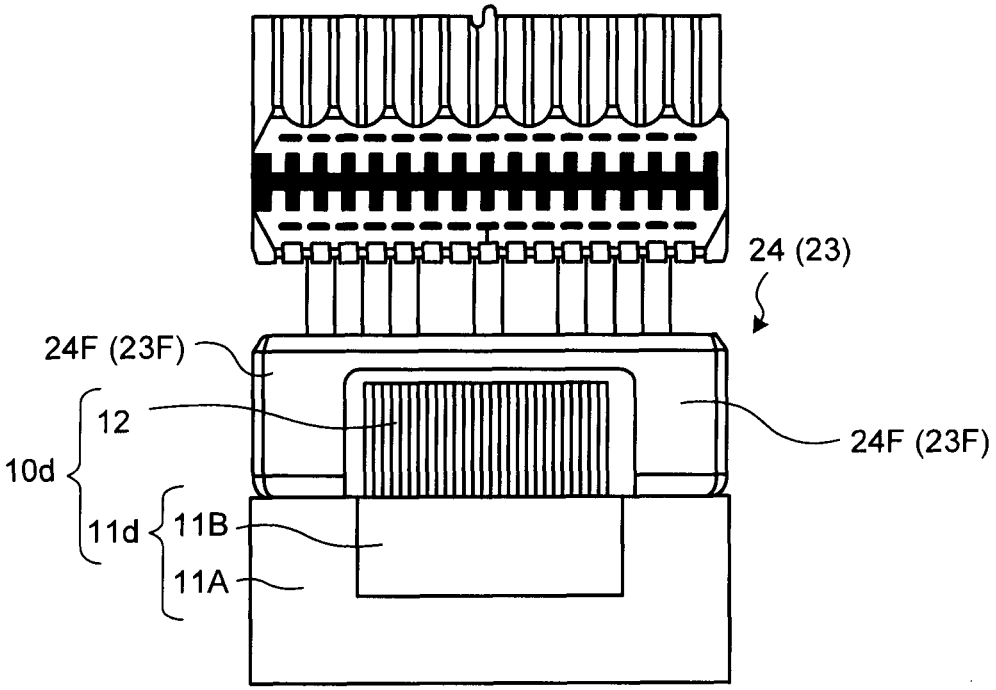
FIG. 9A depicts a modification of the shock-absorbing device according to the embodiment.
Figure 9B:
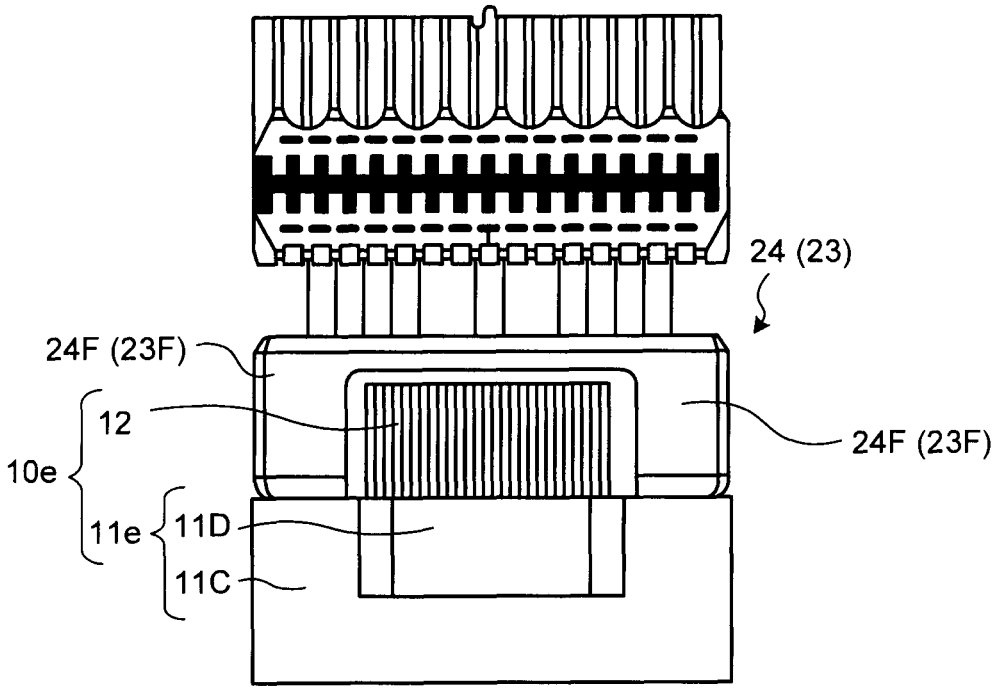
FIG. 9B depicts a modification of the shock-absorbing device according to the embodiment.

A shock-absorbing device 10*e* shown in FIG. 9B has approximately the same configuration as that of the shock-absorbing device 10*d*, and a buffer 11*e* includes a first buffer 11C and a second buffer 11D. In this case, a gap is provided between the first buffer 11C and the second buffer 11D. According to this configuration, a timing of deformation of the first buffer 11C that comes into contact with the legs 24F (23F) of the lower nozzle 24 (or the upper nozzle 23) is made different from that of deformation of the second buffer 11D that comes into contact with the nozzle support 12. That is, the first buffer 11A that comes into contact with the legs 24F (23F) deforms until the gap between the lower nozzle 24 (or the upper nozzle 23) and the nozzle support 12 is filled, and at the timing when the gap is filled, the buffer 11*d*, that is, both of the first buffer 11A and the second buffer 11B start to deform.

Figure 9C:
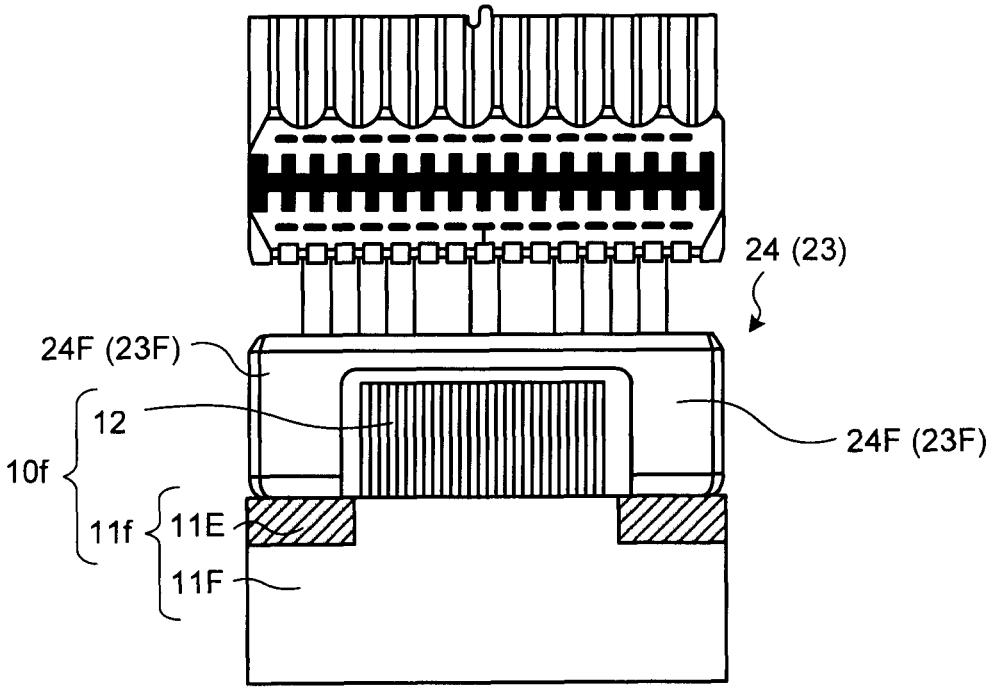
FIG. 9C depicts a modification of the shock-absorbing device according to the embodiment.
Figure 9D:
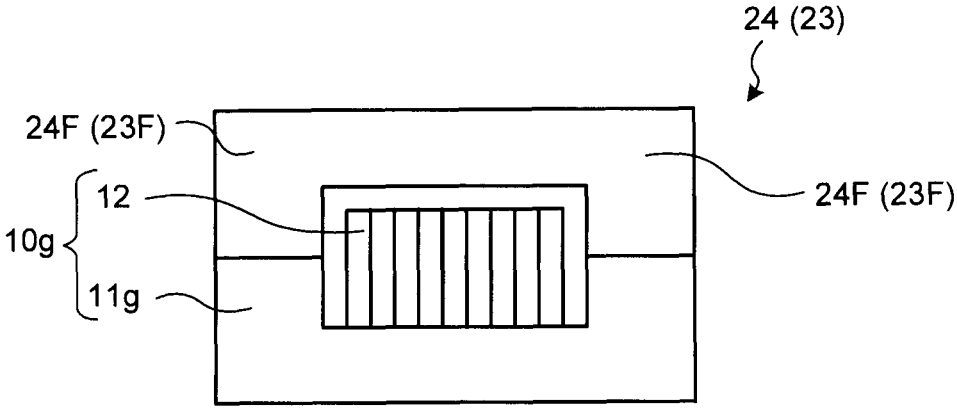
FIG. 9D depicts a modification of the shock-absorbing device according to the embodiment.

In a shock-absorbing device 10*f* shown in FIG. 9C, the buffer 11*d* includes a first buffer 11E and a second buffer 11F. In this case, stiffness of the first buffer 11E in a compression direction is set lower than that of the second buffer 11F in the compression direction, and the first buffer 11A and the lower nozzle 24 (or the upper nozzle 23) are brought into contact with each other, and the second buffer 11B and the nozzle support 12 are brought into contact with each other. At this time, a salient is formed in the second buffer 11F, and the first buffer 11E is arranged around the salient and brought into contact with the lower nozzle 24 (or the upper nozzle 23).

With this configuration, a timing of deformation of the first buffer 11E that comes into contact with the legs 24F (23F) of the lower nozzle 24 (or the upper nozzle 23) is made different from that of deformation of the second buffer 11F that comes into contact with the nozzle support 12. That is, the first buffer 11E that comes into contact with the legs 24F (23F) deforms until the gap between the lower nozzle 24 (or the upper nozzle 23) and the nozzle support 12 is filled, and at the timing when the gap is filled, the buffer 11*e*, that is, both of the first buffer 11E and the second buffer 11F start to deform.

When a contact surface between the nozzle support and the buffer is formed of a flat surface, a change occurs in a load distribution to the buffer coming into contact with the nozzle legs and a load distribution to the buffer coming into contact with the nozzle support. Therefore, even if buffering capacity can be maintained, nozzle-deformation suppression capabilities may not be demonstrated sufficiently. Therefore, as in a shock-absorbing device 10*g* shown in FIG. 9D, the buffering capacity and the nozzle-deformation suppression capabilities are balanced by optimizing a thickness of a buffer 11*g*, or optimizing the buffering capacity between a portion of the buffer 11*g* coming into contact with the legs 24F (23F) of the lower nozzle 24 (or the upper nozzle 23) and a portion of the buffer 11*g* coming into contact with the nozzle support 12 (for example, by using different materials for these portions).

In the present embodiment, the lower nozzle or the upper nozzle of the fuel assembly is supported by the nozzle support, so as to suppress flexure (deformation) of the lower nozzle or the upper nozzle resulting from an impact force due to dropping. Further, the impact force acting on the fuel assembly is absorbed by the buffer. With this configuration, the deformation of the lower nozzle or the upper nozzle due to dropping can be suppressed. Furthermore, because the impact force acting on the fuel assembly is weakened by the buffer, it is possible to suppress the deformation of the fuel assembly.

INDUSTRIAL APPLICABILITY

As described above, the shock-absorbing device for a fuel assembly according to the present invention is useful for transporting of a fuel assembly, and is particularly suitable to suppress deformation of a fuel assembly at the time of dropping.

REFERENCE SIGNS LIST

1 fuel assembly housing container
2 body
2B bottom
2I internal space of body
3 neutron shield
4 primary lid
5 secondary lid
10, 10*a*, 10*b*, 10*c*, 10*d*, 10*e*, 10*f*, 10*g* shock-absorbing device
11, 11*a*, 11*b*, 11*c*, 11*d*, 11*e*, 11*f*, 11*g* buffer
11B bottom plate
11E casing
11I buffer member
11N rod-like member
11P plate material
12, 12*a*, 12*b*, 12*c*, 12*d*, 12*e*, 12*f*, 12*g* nozzle support
12*cp* flat plate
12*cr* rib
20 fuel assembly
21 fuel rod
22 support grid
23 upper nozzle
23F leg
23U depression
24 lower nozzle
24F leg
24U depression
30 basket
30C cell
31 square pipe
32, 33 coupling member
38 spacer

The invention claimed is:

1. A shock-absorbing device for a fuel assembly including a plurality of fuel rods, the shock-absorbing device comprising:

a first nozzle and a second nozzle including one surfaces, respectively, by which the plurality of fuel rods are sandwiched, the first and second nozzles including other surfaces having a plurality of legs for defining first and second depressions, respectively;

a nozzle support fitted to a center portion of the first depression of the first nozzle, the nozzle support being comprised of iron, aluminum alloy containing boron)($B^{10}$), stainless steel, lead, or concrete so that radiation from the fuel assembly is shielded; and a buffer combined with the nozzle support, the buffer having stiffness in a longitudinal direction of the fuel rods being equal to or less than that of the nozzle support, wherein the nozzle support and the buffer are arranged in sequence along the longitudinal direction of the fuel rods as separating from the depressions and wherein the buffer is either one of the followings (a) to (g):

(a) a buffer including a buffer member including a hydrogen-containing resin so as to shield neutron and a casing holding and surrounding the buffer member;

(b) a buffer including a bottom plate and a plurality of plate materials fitted to the bottom plate;

(c) a buffer including a bottom plate and a plurality of rod members arranged with an axial direction being parallel to the longitudinal direction of the fuel rods;

(d) a buffer including a buffer member including a hydrogen-containing resin so as to shield neutron and a casing holding and surrounding the buffer member, the casing being coupled with a pipe for housing the plurality of fuel rods by a coupling member (33);

(e) a buffer including a first buffer that is provided with a depression and contacts the plurality of legs and a second buffer that is provided on the depression and contacts the nozzle support;

(f) a buffer including a first buffer that contacts the plurality of legs and a second buffer that is provided with a salient and contacts the nozzle support at the salient, the first buffer having stiffness in a compression direction lower than that of the second buffer in the compression direction;

(g) a buffer that has a depression and contacts the nozzle support at the depression, the buffer contacting the plurality of legs.

2. The shock-absorbing device for a fuel assembly according to claim 1, wherein the first nozzle is arranged on a bottom side of a fuel assembly housing container for transporting the fuel assembly.

3. The shock-absorbing device for a fuel assembly according to claim 1, wherein the second nozzle is arranged at an opening side of a fuel assembly housing container for transporting the fuel assembly.

4. A fuel assembly housing container comprising:

a body that is a container with a bottom and houses a fuel assembly in an internal space thereof; and the shock-absorbing device for a fuel assembly according to claim 1, which is arranged at least on a bottom of the body.

5. The fuel assembly housing container according to claim 4, wherein the shock-absorbing device for a fuel assembly according to claim 1 is arranged on a lid fitted to an opening of the internal space.

6. A shock-absorbing device for a fuel assembly including a plurality of fuel rods, the shock-absorbing device comprising:

a first nozzle and a second nozzle including one surfaces, respectively, by which the plurality of fuel rods are sandwiched, the first and second nozzles including other surfaces having a plurality of legs for defining first and second depressions, respectively;

a nozzle support fitted to a center portion of the second depression of the second nozzle, the nozzle support being comprised of iron, aluminum alloy containing boron)($B^{10}$), stainless steel, lead, or concrete so that radiation from the fuel assembly is shielded; and a buffer combined with the nozzle support, the buffer having stiffness combined with the first nozzle and the second nozzle in a longitudinal direction of the fuel rods being equal to or less than that of the nozzle support, wherein the nozzle support and the buffer are arranged in sequence along the longitudinal direction of the fuel rods as separating from the depressions and wherein the buffer is either one of the followings (a) to (g):

(a) a buffer including a buffer member including a hydrogen-containing resin so as to shield neutron and a casing holding and surrounding the buffer member;

(b) a buffer including a bottom plate and a plurality of plate materials fitted to the bottom plate;

(c) a buffer including a bottom plate and a plurality of rod members arranged with an axial direction being parallel to the longitudinal direction of the fuel rods;

(d) a buffer including a buffer member including a hydrogen-containing resin so as to shield neutron and a casing holding and surrounding the buffer member (11I), the casing being coupled with a pipe for housing the plurality of fuel rods by a coupling member;

(e) a buffer including a first buffer that is provided with a depression and contacts the plurality of legs and a second buffer that is provided on the depression and contacts the nozzle support;

(f) a buffer including a first buffer that contacts the plurality of legs and a second buffer that is provided with a salient and contacts the nozzle support at the salient, the first buffer having stiffness in a compression direction lower than that of the second buffer in the compression direction;

(g) a buffer that has a depression and contacts the nozzle support at the depression, the buffer contacting the plurality of legs.

7. A shock-absorbing device for a fuel assembly including a plurality of fuel rods, the shock-absorbing device comprising:

a first nozzle and a second nozzle, the first and second nozzles including one surfaces, respectively, by which the plurality of fuel rods are sandwiched and the first and second nozzles including other surfaces having a plurality of legs for defining first and second depressions, respectively;

first and second nozzle supports fitted to a center portion of the first depression of the first nozzle and a center portion of the second depression of the second nozzle, respectively, the first and second nozzle supports being comprised of iron, aluminum alloy containing boron ($B^{10}$), stainless steel, lead, or concrete so that radiation from the fuel assembly is shielded; and first and second buffers combined with the first and second nozzle supports, respectively, the first and second buffers having stiffness in a longitudinal direction of the fuel rods being equal to or less than that of the first and second nozzle supports, respectively, wherein the first nozzle support and the first buffer are arranged in sequence along the longitudinal direction of the fuel rods as separating from the first depression and the second nozzle support and the second buffer are arranged in sequence along the longitudinal direction of the fuel rods as separating from the second depression and wherein the first and second buffers are selected from either one of the followings (a) to (g):

(a) a buffer including a buffer member including a hydrogen-containing resin so as to shield neutron and a casing holding and surrounding the buffer member;

(b) a buffer including a bottom plate and a plurality of plate materials fitted to the bottom plate (11B);

(c) a buffer including a bottom plate and a plurality of rod members arranged with an axial direction being parallel to the longitudinal direction of the fuel rods;

(d) a buffer including a buffer member including a hydrogen-containing resin so as to shield neutron and a casing holding and surrounding the buffer member, the casing being coupled with a pipe for housing the plurality of fuel rods by a coupling member;

(e) a buffer including a first buffer that is provided with a depression and contacts the plurality of legs and a second buffer that is provided on the depression and contacts the nozzle support;

(f) a buffer including a first buffer that contacts the plurality of legs and a second buffer that is provided with a salient and contacts the nozzle support at the salient, the first buffer having stiffness in a compression direction lower than that of the second buffer in the compression direction;

(g) a buffer that has a depression and contacts the nozzle support at the depression, the buffer contacting the plurality of legs.

8. The shock-absorbing device for a fuel assembly according to claim 7, wherein the first nozzle is arranged on a bottom side of a fuel assembly housing container for transporting the fuel assembly.

9. The shock-absorbing device for a fuel assembly according to claim 7, wherein the second nozzle is arranged at an opening side of a fuel assembly housing container for transporting the fuel assembly.

10. A fuel assembly housing container comprising:

a body that is a container with a bottom and houses a fuel assembly in an internal space thereof; and the shock-absorbing device for a fuel assembly according to claim 7, which is arranged at least on a bottom of the body.

11. The fuel assembly housing container according to claim 10, wherein the shock-absorbing device for a fuel assembly is arranged on a lid fitted to an opening of the internal space.

* * * * *